US010927578B2

(12) United States Patent
Vander Bent, Jr.

(10) Patent No.: US 10,927,578 B2
(45) Date of Patent: Feb. 23, 2021

(54) KEY FOR SLIDING PANEL

(71) Applicant: PGT Innovations, Inc., North Venice, FL (US)

(72) Inventor: Kenneth John Vander Bent, Jr., Bradenton, FL (US)

(73) Assignee: PGT Innovations, Inc., North Venice, FL (US)

( * ) Notice: Subject to any disclaimer, the term of this patent is extended or adjusted under 35 U.S.C. 154(b) by 162 days.

(21) Appl. No.: 16/149,181

(22) Filed: Oct. 2, 2018

(65) Prior Publication Data

US 2019/0211593 A1 Jul. 11, 2019

Related U.S. Application Data

(60) Provisional application No. 62/614,677, filed on Jan. 8, 2018.

(51) Int. Cl.
*E05C 17/64* (2006.01)
*E06B 3/44* (2006.01)
(Continued)

(52) U.S. Cl.
CPC ..... *E05D 13/08* (2013.01); *E06B 3/44* (2013.01); *E06B 3/9647* (2013.01); *E05D 15/165* (2013.01); *E05Y 2900/148* (2013.01)

(58) Field of Classification Search
CPC ..... E05D 13/08; E06C 3/9647; E06C 3/9648; E05C 17/64
See application file for complete search history.

(56) References Cited

U.S. PATENT DOCUMENTS 1,781,912 A * 11/1930 Barnes ..... E05C 17/64 49/418
2,287,741 A * 6/1942 Levyn ..... E06B 3/50 49/173
(Continued)

FOREIGN PATENT DOCUMENTS

AU 2007231858 6/2014
CN 203716672 7/2014
(Continued)

OTHER PUBLICATIONS

EBAY; "Remsafe Venlock Aluminium Sliding Window Restrictor Lock LC888 Black Keyed Alike", located at <http://www.ebay.co.uk/itm/Levcol-Aluminium-Sliding-Window-Lock-LC888-Keyed-Alike-/261089777262?clk_rvr_id=1315224733038&rmvSB=true>, Sep. 20, 2017, 7pgs.
(Continued)

*Primary Examiner* — Catherine A Kelly
(74) *Attorney, Agent, or Firm* — Taylor English Duma LLP

(57) ABSTRACT

A corner key assembly for a sliding panel system including a panel frame and a movable panel can include a corner key including a distal and proximal end, and a guide chamber being defined in the corner key, the guide chamber extending from the distal end towards the proximal end of the corner key; a guide slidingly movable relative to the corner key, at least a portion of the guide being configured to be positioned in the guide chamber and a portion of the guide being configured to extend from the guide chamber; and a biasing element positioned in the guide chamber between the guide and the proximal end, the biasing element configured to urge a portion of the guide from the guide chamber away from the corner key and into frictional engagement with the panel
(Continued)

frame to hold the panel in a desired position relative to the panel frame.

17 Claims, 15 Drawing Sheets

(51) Int. Cl.
*E06B 3/964* (2006.01)
*E05D 15/16* (2006.01)

(56) References Cited

U.S. PATENT DOCUMENTS 2,323,559 A * 7/1943 Mills ..... E05D 13/08 49/417
2,423,495 A * 7/1947 Galuska ..... E05C 17/64 49/420
2,733,788 A * 2/1956 Farmer ..... E06B 3/9765 403/295
2,829,911 A * 4/1958 Green ..... E05C 17/64 49/418
4,274,469 A 6/1981 Kuyper et al.
5,099,963 A * 3/1992 Alchin ..... E05D 13/08 16/193
5,119,872 A * 6/1992 Engebretson ..... E05D 15/066 16/105
5,343,594 A * 9/1994 Harvey ..... A47K 3/34 16/105
5,450,701 A * 9/1995 White ..... E06B 3/9647 160/381
5,473,853 A * 12/1995 Guillemet ..... E06B 9/52 160/105
5,881,498 A 3/1999 Goggin et al.
6,736,185 B2 5/2004 Smith et al.
6,813,862 B2 * 11/2004 Perich ..... E05B 65/0876 16/105
6,845,593 B2 * 1/2005 Silverman ..... E05C 1/04 52/655.1
7,073,292 B1 * 7/2006 Minter ..... E05B 65/0876 160/381
7,337,824 B2 3/2008 Berger
8,056,993 B2 * 11/2011 Stock ..... E05D 5/0215 312/223.1
8,550,507 B2 10/2013 Barton et al.
9,493,970 B2 11/2016 Campbell et al.
9,611,688 B1 * 4/2017 Vanderbent, Jr. ..... E06B 3/9688
10,174,544 B2 * 1/2019 Kellum ..... E06B 3/9645
2007/0297854 A1 * 12/2007 Ohrstrom ..... E05D 15/0682 403/401
2008/0283200 A1 11/2008 Hummel et al.
2015/0052817 A1 2/2015 Bourgoin et al.
2016/0244995 A1 8/2016 Gartner
2017/0067271 A1 3/2017 Schroeder

FOREIGN PATENT DOCUMENTS

DE 3844101 7/1990
EP 0679785 11/1995
GB 2311324 9/1997

OTHER PUBLICATIONS

The Home Depot; Product entitled: "Aluminum Cam Action Sliding Window Lock", located at <URL: http://www.homedepot.com/p/Prime-Line-Aluminum-Cam-Action-Sliding-Window-Lock-U-9824/100148207>, accessed on Sep. 20, 2017, 4 pgs.

* cited by examiner

KEY FOR SLIDING PANEL

CROSS-REFERENCE TO RELATED APPLICATIONS

This application claims the benefit of and priority to U.S. Provisional Patent 62/614,677, filed Jan. 8, 2018, which is incorporated in its entirety in this document by reference.

TECHNICAL FIELD

This disclosure relates to sliding panel systems. More specifically, this disclosure relates to a key for a sliding panel system configured to hold a panel in a desired position relative to a panel frame.

BACKGROUND

A sliding panel system can have at least one sliding panel such as a window, a clear plastic viewing panel, a screen, a vent, and the like that can slide vertically relative to a fixed frame of the panel. For example, a user can slide the panel from a first position to a second position that is different vertically than the first position.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a corner key assembly for a sliding panel system comprising a panel frame and a panel slidingly movable relative to the panel frame, the corner key assembly comprising: a corner key comprising a distal end and a proximal end spaced from and opposed to the distal end and a guide chamber being defined in the corner key, the guide chamber extending from the distal end towards the proximal end of the corner key towards the proximal end of the corner key along a first longitudinal axis; a guide slidingly movable relative to the corner key, at least a portion of the guide being configured to be positioned in the guide chamber; and a first biasing element positioned in the guide chamber between the guide and the proximal end of the corner key, the first biasing element configured to urge a portion of the guide from the guide chamber away from the corner key and into frictional engagement with the panel frame to hold the panel in a desired position relative to the panel frame.

Also disclosed is a panel assembly comprising: a panel frame comprising a plurality of jamb tracks; and a panel slidable vertically relative to the panel frame along a jamb track of the plurality of jamb tracks, the panel comprising a first stile, a second stile spaced from and opposed to the first stile, a first rail coupled to and extending between the first stile and the second stile, a second rail coupled to and extending between the first stile and the second stile, the second rail being spaced from and opposed to the first rail, and a corner key assembly comprising: a corner key comprising a distal end and a proximal end spaced from and opposed to the distal end, and a guide chamber being defined in the corner key, the guide chamber extending from the distal end towards the proximal end of the corner key; a guide slidingly movable relative to the corner key, at least a portion of the guide being configured to be positioned in the guide chamber; and a biasing element positioned in the guide chamber between the guide and the proximal end of the corner key, the biasing element configured to urge a portion of the guide from the guide chamber away from the corner key and into frictional engagement with the jamb track to hold the panel in a desired position relative to the panel frame.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
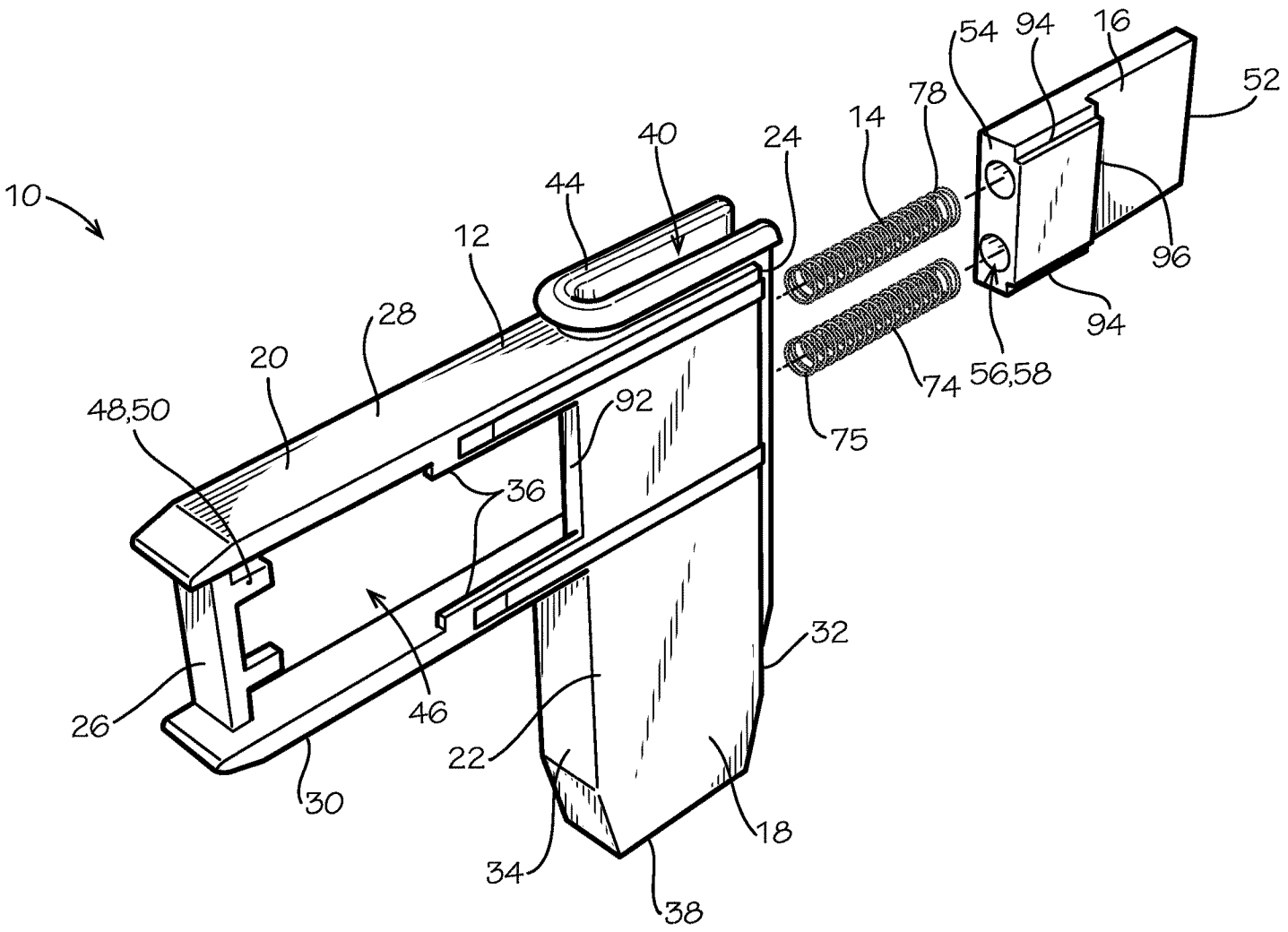
FIG. 1 is a first exploded perspective view of a corner key assembly in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed are panel systems comprising a key assembly and associated methods, systems, devices, and various apparatus. The key assembly can be a corner key assembly positioned in a corner of a movable panel and configured to hold the panel in a desired position relative to a fixed panel frame. It would be understood by one of skill in the art that the disclosed corner key assemblies are described in but a few exemplary embodiments among many. No particular terminology or description should be considered limiting on the disclosure or the scope of any claims issuing therefrom.

FIGS. 1-6 show a corner key assembly 10 comprising a corner key 12, a biasing element 14, and a guide 16, according to various aspects. The guide 16 can be slidingly movable relative to the corner key 12 so that in use, the biasing element 14 can urge the guide 16 into frictional engagement with a portion of a panel frame 102, such as a jamb track 104 (illustrated in FIG. 7).

Figure 4:
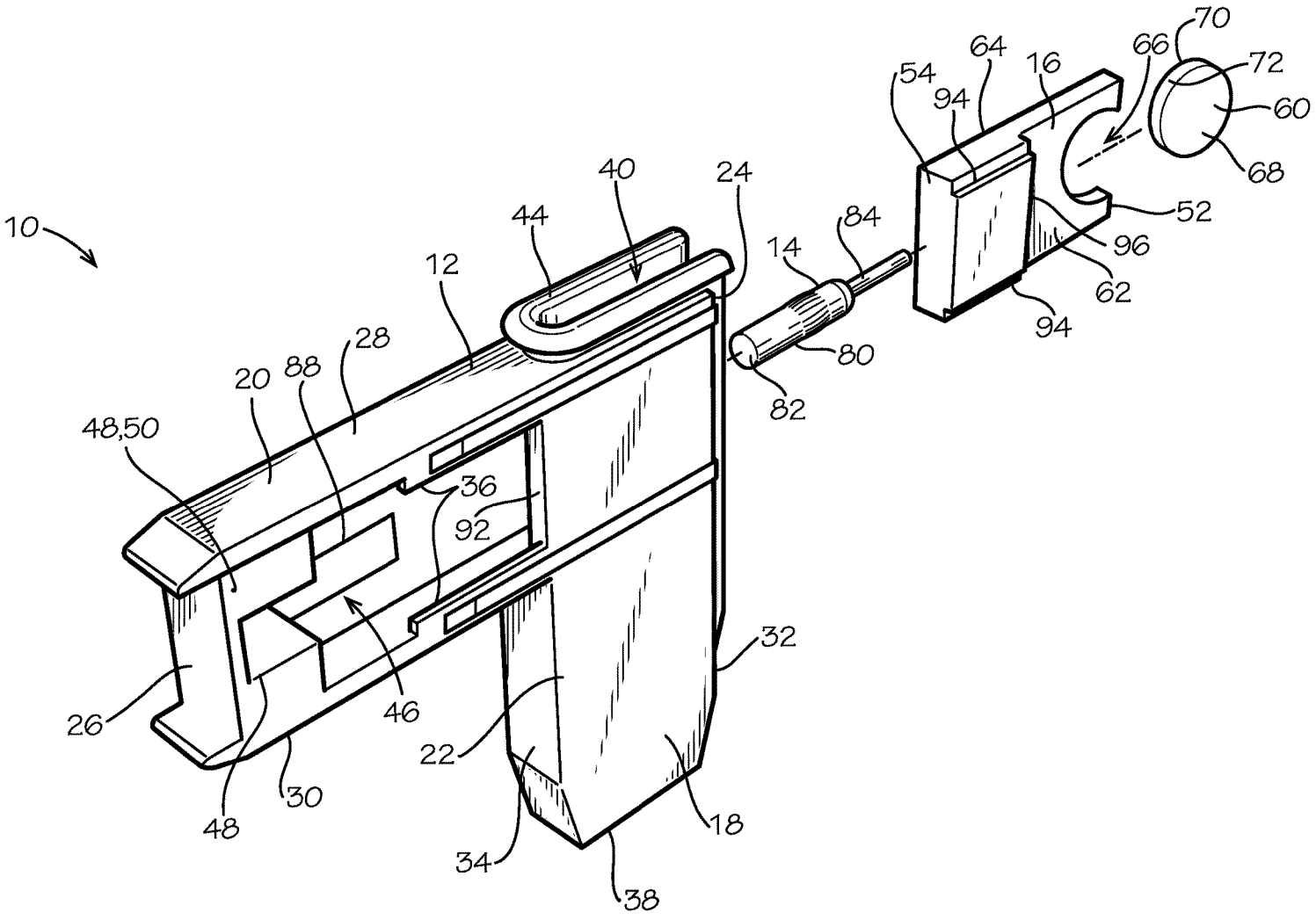
FIG. 4 is a first exploded perspective view of a corner key assembly in accordance with another aspect of the present disclosure.

As shown in FIGS. 1 and 4, the corner key 12 comprises a key body 18 comprising an upper body portion 20 coupled to or formed monolithically with a lower body portion 22. The upper body portion 20 comprises a distal end 24, a proximal end 26 spaced from and opposed to the distal end 24, an upper surface 28 extending between the distal end 24 and the proximal end 26, and a lower surface 30 spaced from and opposed to the upper surface 28. The lower body portion 22 comprises a distal end 32, a proximal end 34 spaced from and opposed to the distal end 32, and a lower surface 38 spaced from and opposed to the upper surface 28. With the distal end 24 of the upper body portion 20 substantially aligned with the distal end 32 of the lower body portion 22, the upper body portion 20 can be coupled to or formed monolithically with the lower body portion 22. In one aspect, a width of the lower body portion 22 can be less than a width of the upper body portion 20 so that when the upper body portion 20 and the lower body portion 22 are coupled together or formed monolithically, the key body 18 can be substantially L-shaped. Alternatively and in other aspects, the width of the lower body portion 22 can be greater than or substantially equal to the width of the upper body portion 20.

In one aspect, a longitudinal notch 40 comprising a notch wall 42 (illustrated in FIGS. 2 and 5) can be defined in the distal end 24, 32 of the key body 18. For example, the notch 40 can extend from the upper surface 28 of the upper body portion 20 through the lower surface 30 of the lower body portion 22. In another aspect, the notch 40 can be defined in and extend through a portion of the distal end 24, 32 of the key body 18. For example, the notch 40 can extend from the upper surface 28 of the upper body portion 20 through the lower surface 30 of the upper body portion 20 and into the lower body portion 22.

Figure 2:
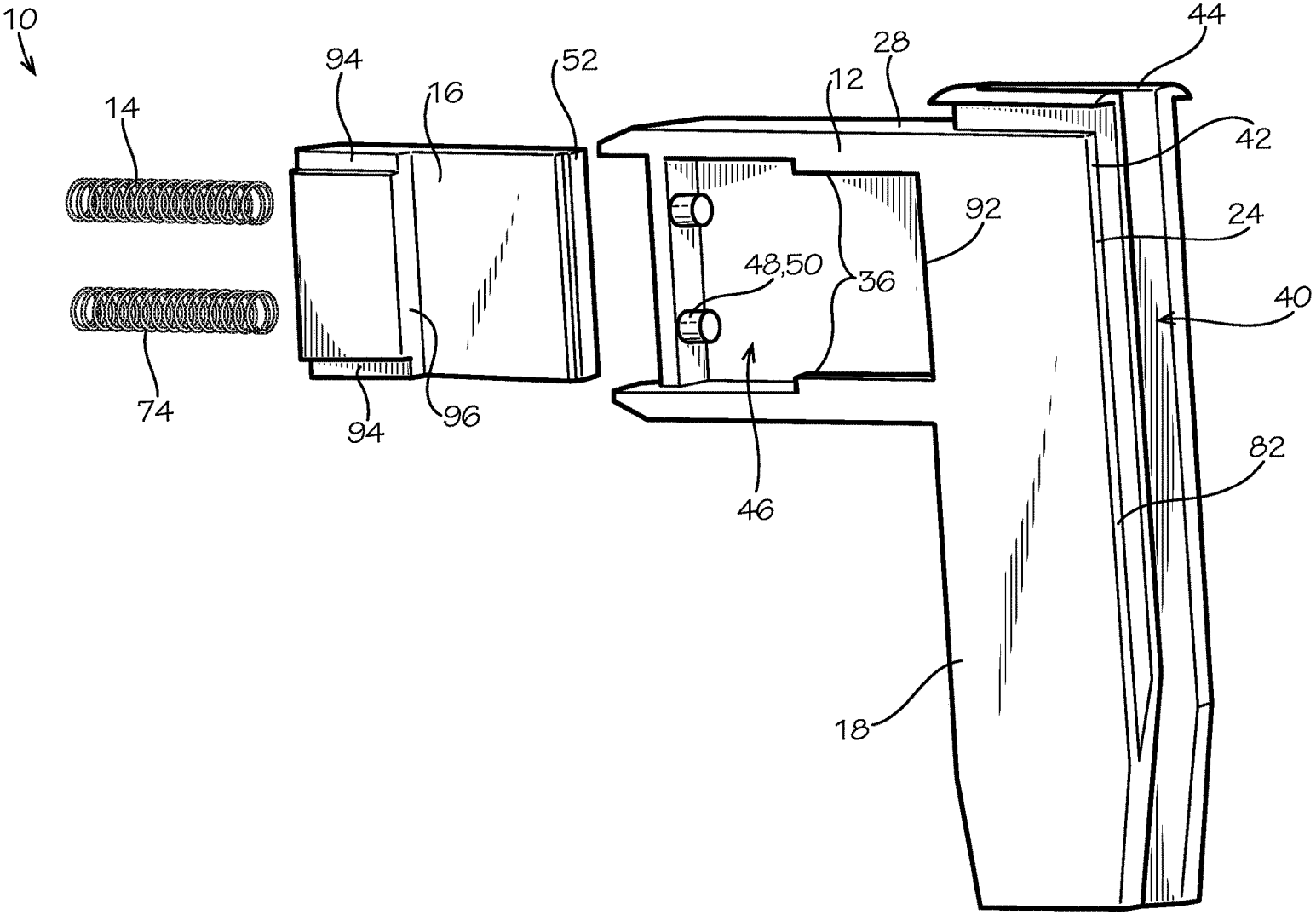
FIG. 2 is a second exploded perspective view of the corner key assembly of FIG. 1.
Figure 5:
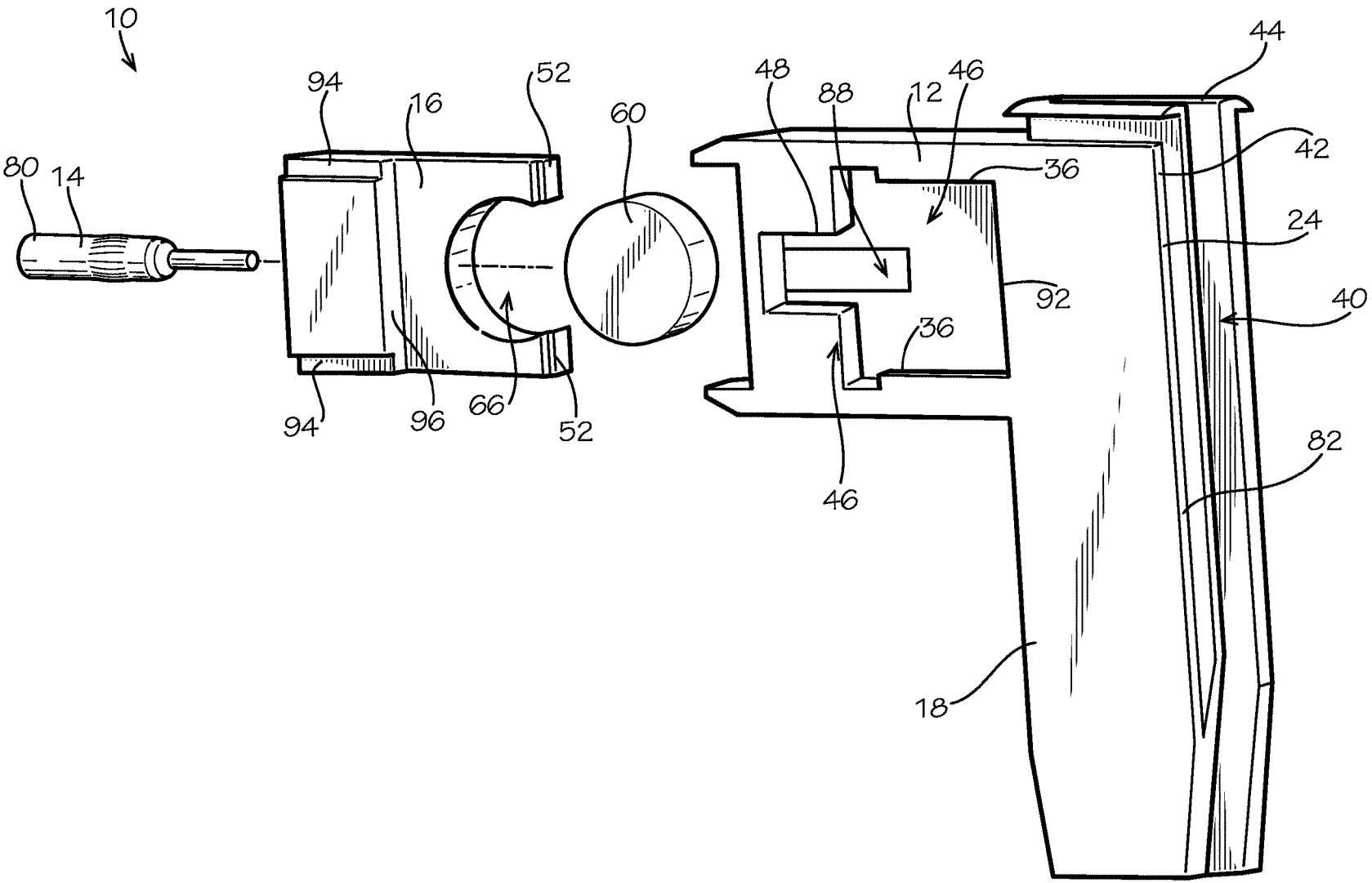
FIG. 5 is a second exploded perspective view of the corner key assembly of FIG. 4.

In one aspect, the key body 18 further comprises at least one guide rail 44 positioned in the notch 40 or, alternatively, formed monolithically with the notch wall 42 of the notch 40. The guide rail 44 can be a substantially U-shaped longitudinal rail configured to slidingly engage a portion of the panel frame 102, such as the jamb track 104 (illustrated in FIG. 7). As illustrated in FIGS. 2 and 5 and in various aspects, the guide rail 44 can extend above the upper surface 28 of the upper body portion 20, and the guide rail 44 can extend beyond the distal end 24, 32 of the key body 18.

A guide chamber 46 can be defined in the key body 18, the guide chamber 46 sized and configured to receive at least a portion of the guide 16 therein. In one aspect, the guide chamber 46 can be defined in the upper body portion 20 and can extend from the distal end 24 towards the proximal end 26 of the upper body portion 20. In another aspect, the guide chamber 46 can be in communication with the notch 40 of the key body 18 so that the guide 16 positioned in the guide chamber 46 can exit the guide chamber 46 through the notch 40.

Optionally, in other aspects, the key body 18 can further comprise a biasing element mount 48 defined in or positioned on the proximal end 26 of the upper body portion 20 of the key body 18 and facing the guide chamber 46. The biasing element mount 48 can be configured to secure the biasing element 14 in a desired position relative to the key body 18. For example, a tab 50 can extend from the proximal end 26 of the upper body portion 20 into the guide chamber 46 to secure the biasing element 14 in a desired position in the guide chamber 46. In another example, (not shown) at least one recessed area can be defined in the proximal end 26 of the upper body portion 20 facing the guide chamber 46 to secure the biasing element 14 in a desired position in the guide chamber 46. The key body 18 can further comprise a pair of guide rails 36 and a guide stop 92 facing the guide chamber 46.

The guide 16 can be an insert slidingly positionable in the guide chamber 46 of the key body 18. That is, the guide 16 can be sized and configured to be positioned in the guide chamber 46. The guide 16 comprises a first end 52 and an opposed second end 54 spaced from the first end 52. In one aspect, the second end 54 of the guide 16 can be sized and configured to couple to or engage the biasing element 14. For example, a biasing element mount 56 can be defined in or positioned on the second end 54 of the guide 16. The biasing element mount 56 of the guide 16 can be at one or more tabs (not shown) extending away from the second end 54 or, as shown, one or more recessed areas or holes 58 defined in the second end 54 of the guide 16 to secure the biasing element 14 in a desired position relative to the guide 16. In one aspect, the guide 16 can further define a pair of guide notches 94. In some aspects, a thickness of the first end 52 of the guide 16 can be less than a thickness of the second end 54 of the guide, and a shoulder 96 can be defined between the first end 52 and the second end 54. Alternatively, in other aspects, the thickness of the first end 52 of the guide 16 can be greater than or substantially equal to the thickness of the second end 54 of the guide 16.

Figure 3:
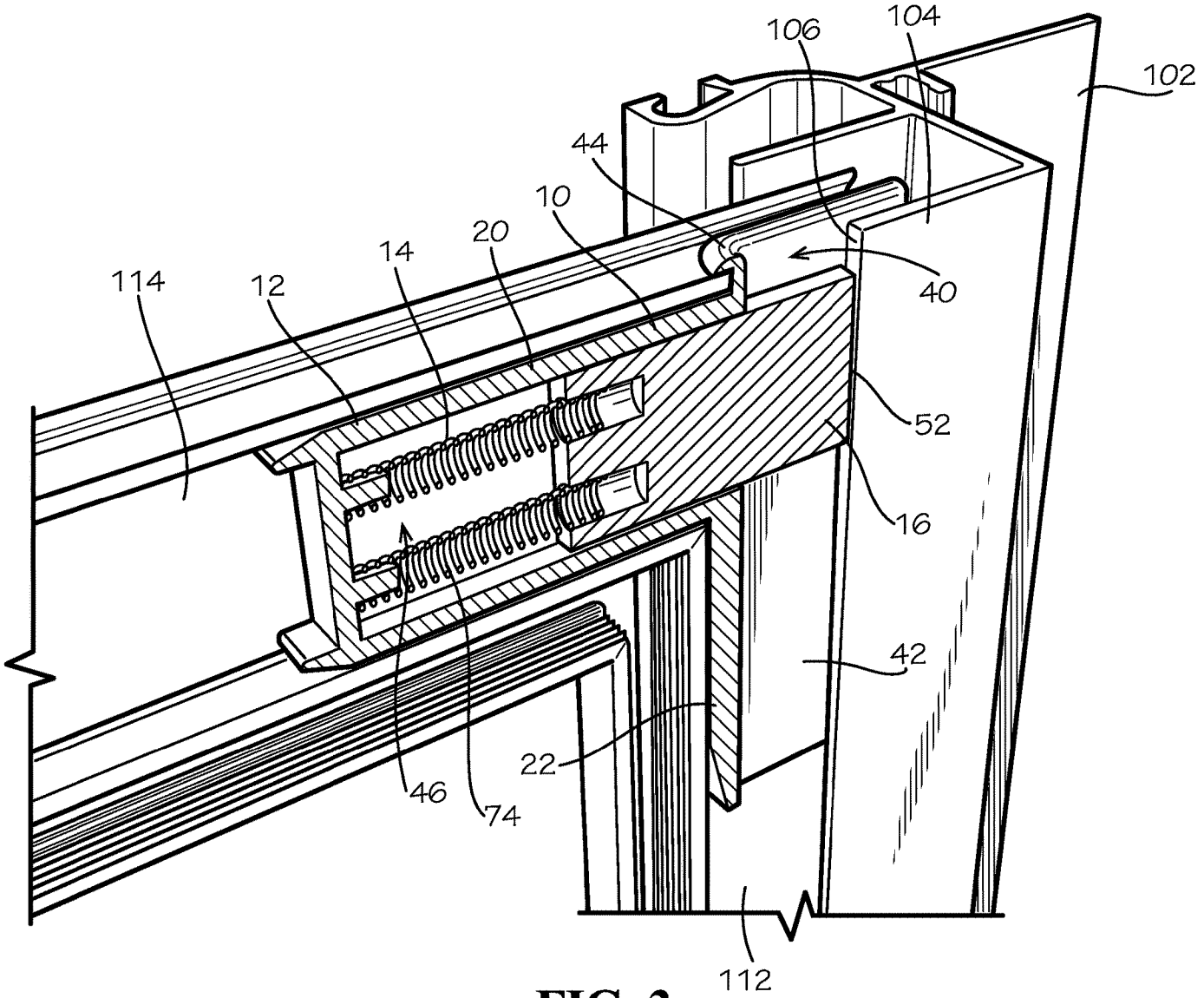
FIG. 3 is cross-sectional view of the corner key assembly of FIG. 1 positioned in a panel assembly.

In one aspect and as illustrated in FIG. 3, the first end 52 of the guide 16 can be sized and configured to frictionally engage the jamb track 104 of the panel frame 102. For example, the first end 52 of the guide 16 can be a substantially planar surface configured to be substantially parallel to an end face 106 of the jamb track 104.

Figure 6:
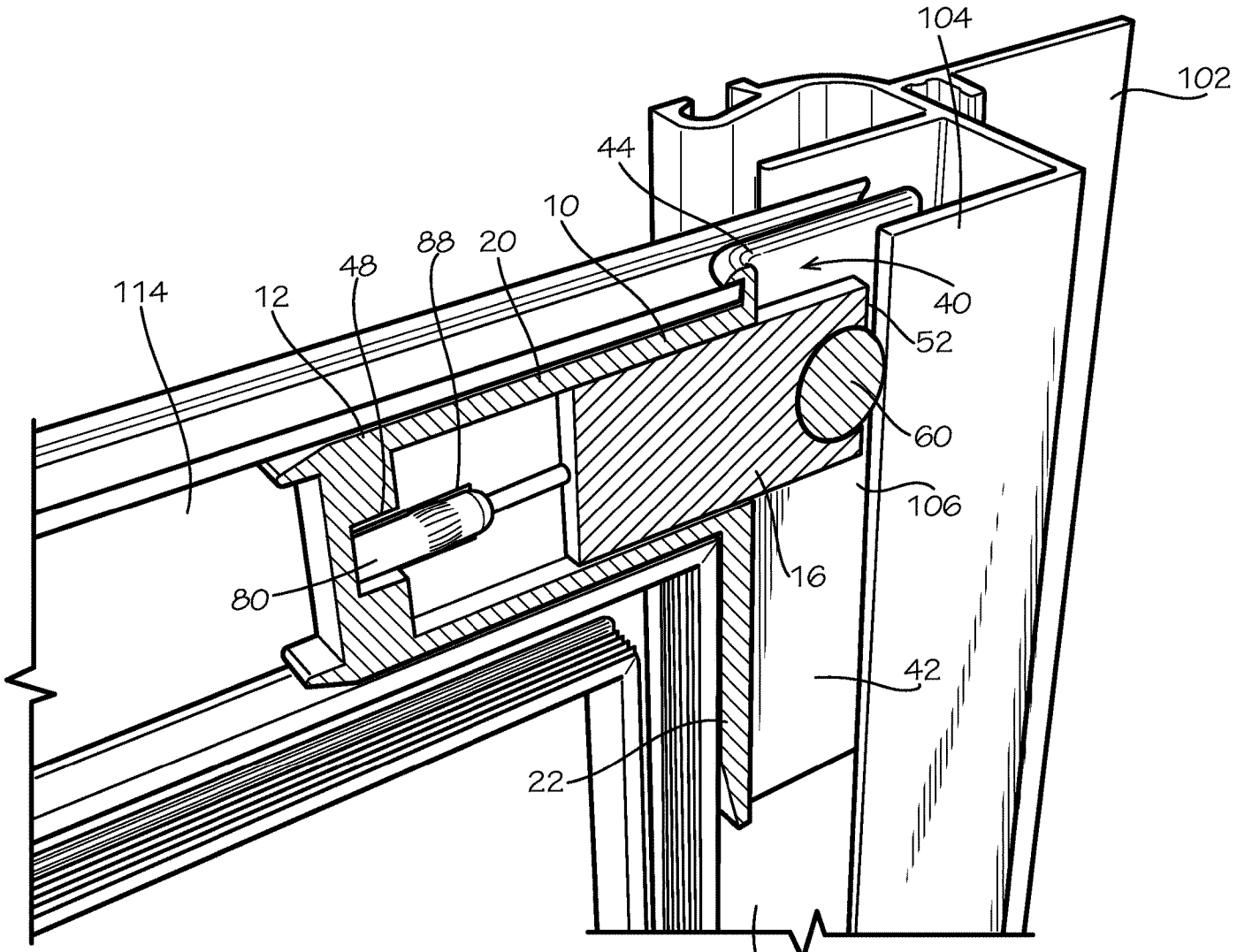
FIG. 6 is cross-sectional view of the corner key assembly of FIG. 4 positioned in a panel assembly.
Figure 7:
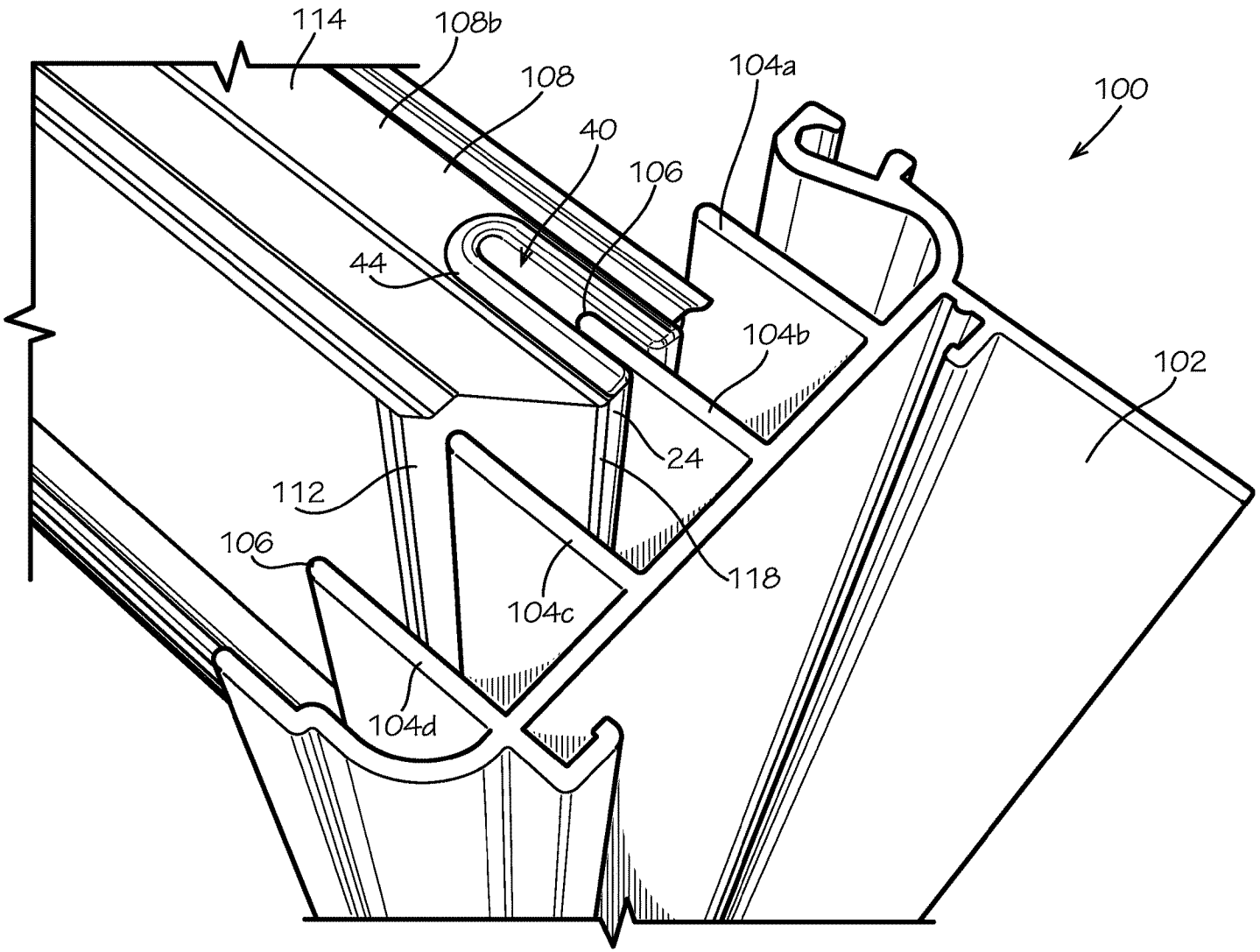
FIG. 7 is a perspective view of panel assembly comprising a panel frame and a panel comprising the corner key assembly of FIG. 1 and/or FIG. 4.

In another aspect and as illustrated in FIGS. 4-6, the guide 16 can comprise a roller wheel 60 positioned in the guide 16 such that the roller wheel 60 can rotatingly engage the jamb track 104 of the panel frame 102. In this aspect, the guide 16 can further comprise a first face 62 extending between the first end 52 and the second end 54, and a second face 64 extending between the first end 52 and the second end 54 and opposed to the first face 62. In another aspect, a bore 66 can be defined in the guide 16, the bore 66 extending from the first face 62 to the second face 64 of the guide 16. In this aspect, the bore 66 can be substantially cylindrical and comprise an inner diameter. In a further aspect, the inner diameter of the bore 66 can extend beyond the first end 52 of the guide 16. That is, the cylindrical bore 66 can be offset so that a portion of the cylinder of the bore 66 is defined by the guide 16 and a portion of the cylinder of the bore 66 extends beyond the first end 52 of the guide 16.

The roller wheel 60 can be a substantially circular disc having a first disc face 68 and a second disc face 70 spaced from and substantially parallel to the first disc face 68. In one aspect, the roller wheel 60 comprises a wheel thickness substantially equal to the thickness of the first end 52 of the guide 16. In other aspects, the wheel thickness of the roller wheel 60 can be less than or greater than the thickness of the first end 52 of the guide 16. In another aspect, a disc wall 72 can extend between the first disc face 68 and the second disc face 70. In this aspect, the disc wall 72 can be substantially normal to the first disc face 68 and/or the second disc face 70. The roller wheel 60 can comprise an outer diameter that is substantially the same as the inner dimeter of the bore 66 of the guide 16. Optionally, in other aspects, the roller wheel 60 can comprise an outer diameter that is less than the inner dimeter of the bore 66 of the guide 16. When assembled as described more fully below, the roller wheel 60 can rotate about a longitudinal axis that is substantially normal to the end face 106 of the jamb track 104. In one aspect, when assembled, a portion of the first disc face 68, the second disc face 70, and the disc wall 72 of the roller wheel 60 can extend beyond the first end 52 of the guide 16.

The biasing element 14 can be positioned between the proximal end 26 of the upper body portion 20 of the key body 18 and the second end 54 of the guide 16 and configured to urge the guide 16 away from the proximal end 26. In one aspect and as illustrated in FIGS. 1-3, the biasing element 14 can be at least one spring 74 comprising a first spring end 76 coupled to or in contact with the biasing element mount 48 of the key body 18, which can be the tab 50 sized to fit in the first spring end 76 in the current aspect, and an opposed second spring end 78 coupled to or in contact with the biasing element mount 56, which can be the hole 58 sized to accept the second spring end 78 in the current aspect of the guide 16. Two springs 74 are shown in FIGS. 1-3, though any number of springs 74 can be present as desired in various other aspects. In this aspect, the spring 74 can be a compressive spring configured to urge the guide 16 away from the proximal end 26 until the first end 52 of the guide 16 is positioned in the notch 40 of the key body 18.

In another aspect and as illustrated in FIGS. 4-6, the biasing element 14 can comprise at least one piston 80 comprising a first piston end 82 coupled to or in contact with the biasing element mount 48 of the key body 18, and an opposed second piston end 84 coupled to or in contact with the biasing element mount 56 or the second end 54 of the guide 16. In this aspect, a piston window 88 can be defined in the key body 18 that can be sized to hold a portion of the piston 80, such as a body of the piston 80 in the piston window 88 to prevent undesired movement of the first end 82 of the piston 80 relative to the key body 18. In this aspect, the piston 80 can comprise a plunger configured to urge the second piston end 84 of the piston 80 away from the first piston end 82 such that the guide 16 is urged away from the proximal end 26 of the key body 18 until the first end 52 of the guide 16 is positioned in the notch 40 of the key body 18. One piston 80 is shown in FIGS. 4-6, though any number of pistons 80 can be present as desired in various other aspects.

To assemble the corner key assembly 10 as illustrated in FIGS. 1-3, the guide 16 can be positioned in the guide chamber 46 with the second end 54 of the guide 16 facing the proximal end 26 of the upper body portion 20. The guide rails 36 of the corner key 12 can engage the guide notches 94 defined in the guide 16 to facilitate sliding of the guide 16 relative to the corner key 12. The shoulder 96 of the guide 16 can engage the guide stop 92 of the corner key 12. The spring 74 can be positioned in the guide chamber 46 with the first spring end 76 of the spring 74 coupled to or positioned in the biasing element mount 48 of the key body 18. The second spring end 78 of the spring 74 can be coupled to or positioned in the biasing element mount 56 of the guide 16. In the assembled position, the spring 74 can urge the first end 52 of the guide 16 into the notch 40 of the key body 18, guided by engagement of the guide rails 36 with the guide notches 94. The guide stop 92 engaging the shoulder 96 can prevent the guide 16 from being urged beyond a predetermined position, such as out of the chamber 46 and/or the notch 40 completely.

To assemble the corner key assembly 10 as illustrated in FIGS. 4-6, the roller wheel 60 can be positioned in the bore 66 defined in the guide 16 such that the first disc face 68 of the roller wheel is substantially parallel to the first face 62 of the guide 16. The guide 16 can be positioned in the guide chamber 46 with the second end 54 of the guide 16 facing the proximal end 26 of the upper body portion 20. The piston 80 can be positioned in the guide chamber 46 with the first piston end 82 of the piston 80 coupled to or positioned in the biasing element mount 48, which can be a notch sized to hold the first piston end 82 of the piston 80. The second piston end 84 of the piston 80 can engage the second end 54 of the guide 16. In the assembled position, the piston 80 can thereby urge the first end 52 of the guide 16 into the notch 40 of the key body 18 similar to the corner key assembly of FIG. 1-3.

The corner key assembly 10 can be positioned in a panel 108 of a panel assembly 100, illustrated in FIGS. 7-10. The panel assembly 100 can be any type of panel assembly, including, for example and without limitation, a window, a screen, a vent, or a clear plastic viewing panel. The panel assembly 100 can comprise the panel 108 that is slidable vertically relative to the fixed panel frame 102. For example, in FIG. 10, the panel assembly 100 comprises four panels 108*a, b, c*, and *d* that can each slide vertically along a respective jamb track 104*a, b, c*, and *d* (illustrated in FIG. 7) relative to the panel frame 102. It is contemplated, however, that the panel assembly 100 can comprise any number of panels 108. Each panel 108 comprises a first stile 110, a second stile 112 spaced from and opposed to the first stile 110, a first rail 114 coupled to and extending between the first stile 110 and the second stile 112, and a second rail 116 coupled to and extending between the first stile 110 and the second stile 112, the second rail 116 being spaced from and opposed to the first rail 114.

Figure 8:
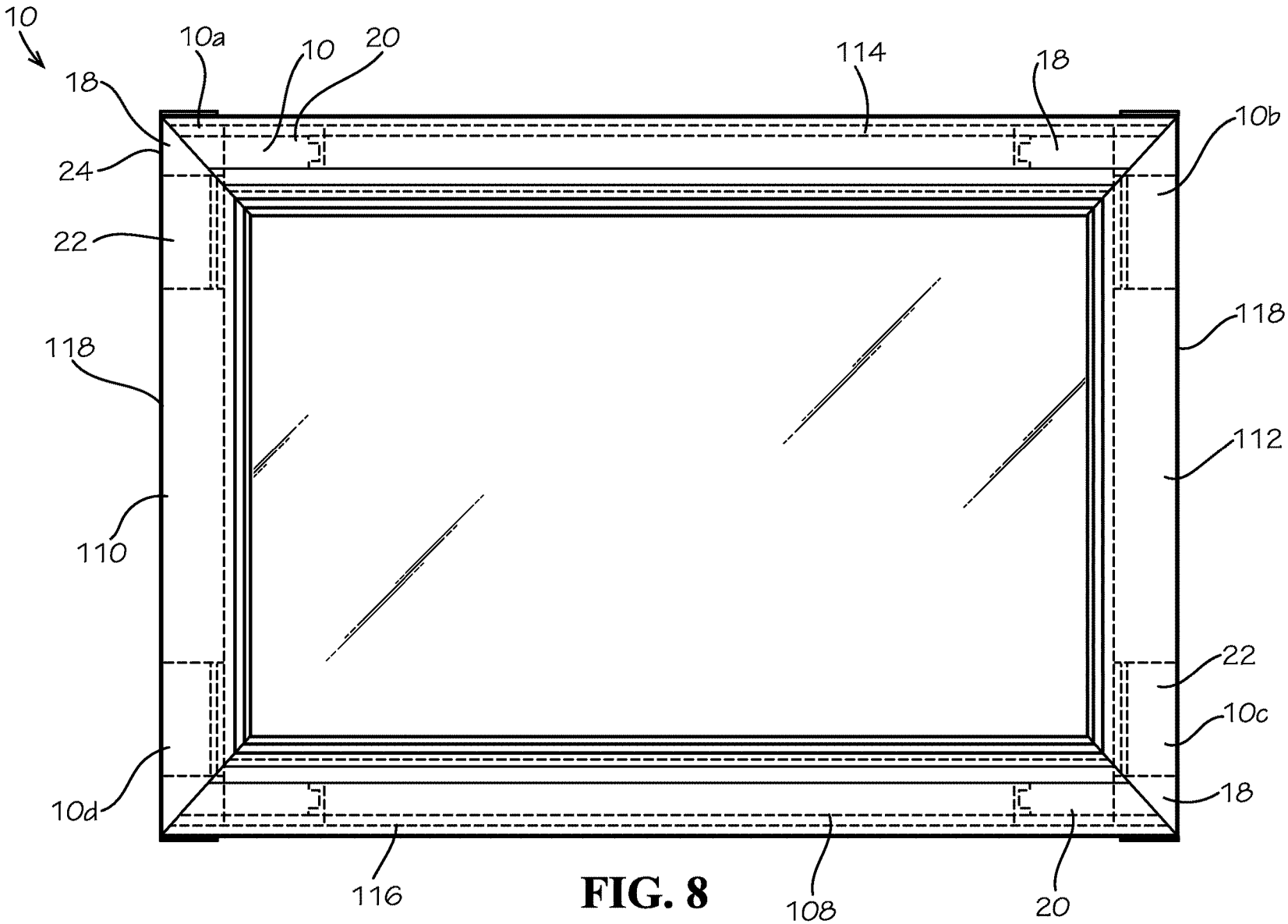
FIG. 8 is an elevation view of a panel of a panel assembly, wherein the dashed lines represent the corner key assembly of FIG. 1 and/or FIG. 4 positioned in the panel.
Figure 9:
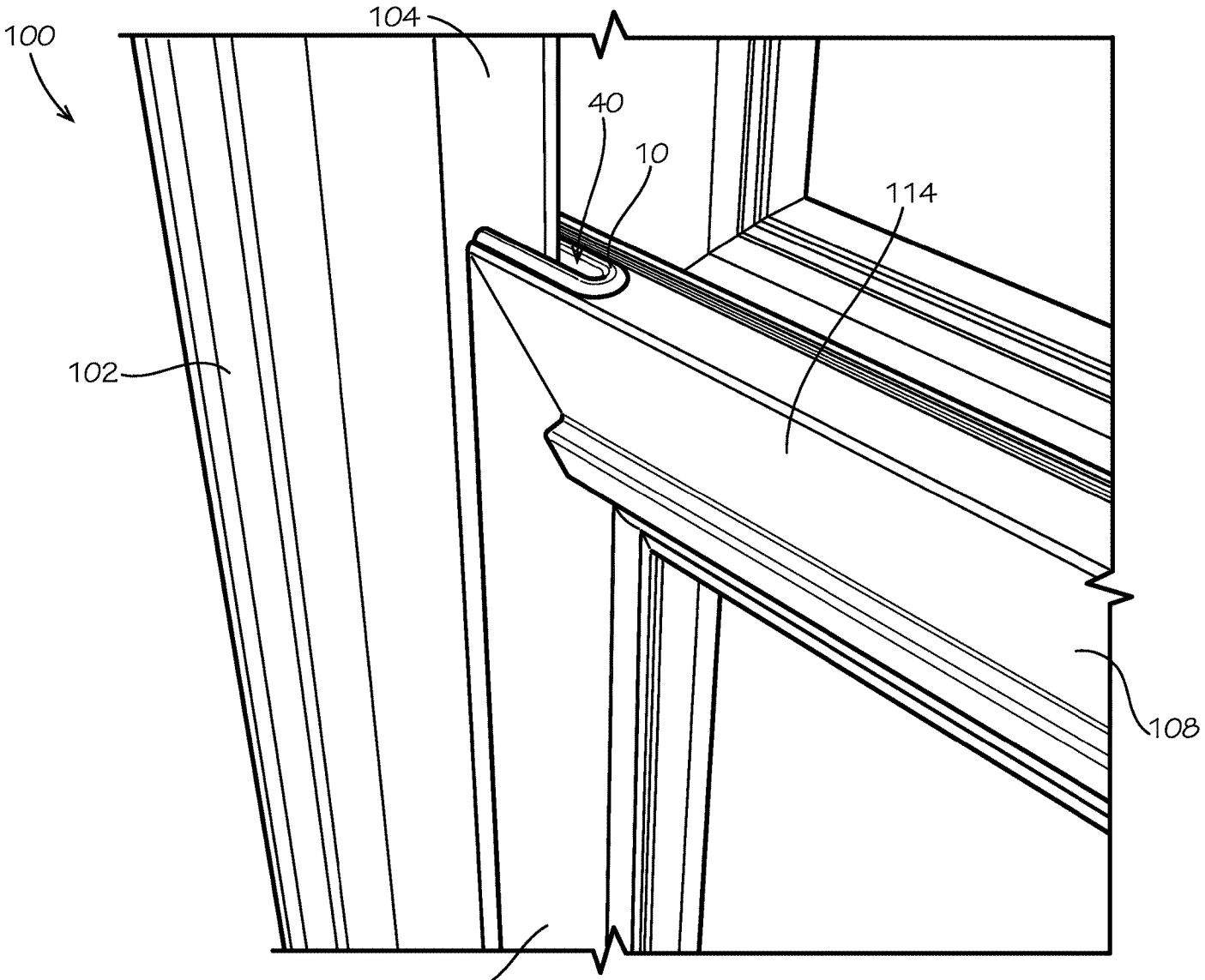
FIG. 9 is a perspective view of panel assembly comprising a panel frame and a panel comprising the corner key assembly of FIG. 1 and/or FIG. 4.
Figure 10:
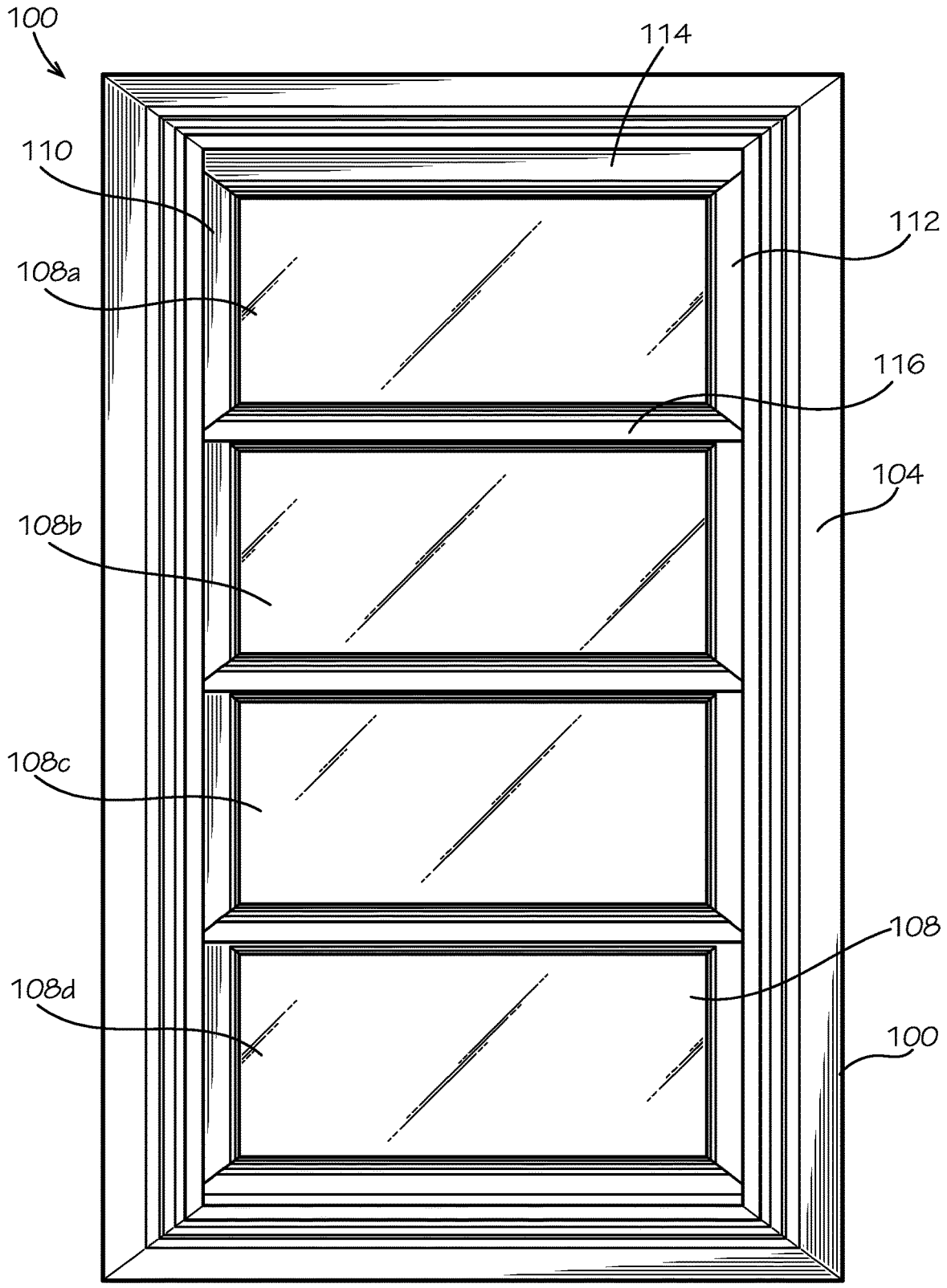
FIG. 10 is an elevational view of a panel assembly comprising a plurality of panels.

In one aspect and as illustrated in FIG. 8, the corner key assembly 10 can be positioned in a corner of the panel 108 where the first stile 110 or the second stile 112 is coupled to the first rail 114 and/or the second rail 116. For example, the upper body portion 20 of the key body 18 can be positioned in the first rail 114 or the second rail 116, and the lower body portion 22 of the key body 18 can be positioned in the first stile 110 or the second stile 112. In another aspect, the corner key assembly 10 can be positioned in the panel 108 such that portions of the key body 18, such as the distal end 24 of the key body 18 or the guide rail 44, are substantially aligned with a distal edge 118 of the first stile 110 and/or the second stile 112. Optionally, in other aspects, the corner key assembly 10 can be positioned in the panel 108 such that portions of the key body 18, such as the guide rail 44, extend beyond the distal edge 118 of the first stile 110 and/or the second stile 112. In still other aspects, the corner key assembly 10 can be positioned in the panel 108 such that the distal edge 118 of the first stile 110 and/or the second stile 112 extends beyond the distal end 24 of the key body 18. In another aspects, the distal end 24 of the key body 18 can be substantially parallel with the distal edge 118 of the first stile 110 and/or the second stile 112. With the corner key assembly 10 positioned in the panel 108, in one aspect, a portion of the at least one guide rail 44 of the key body 18 can extend beyond an outer portion of the first rail 114 or the second rail 116 of the panel 108.

In one aspect, a plurality of corner key assemblies 10 can be positioned in a panel 108. For example, a corner key assembly 10*a, b, c*, and *d* can be positioned in each corner of the panel 108.

Each panel 108 of the panel assembly 100 can be positioned on the panel frame 102 such that the jamb track 104 of the panel frame 102 is positioned in the notch 40 of the corner key 12. In one aspect, with the jamb track 104 of the panel frame 102 positioned in the notch 40, the first end 52 of the guide 16 can frictionally engage the end face 106 of the jamb track 104, and force exerted by the biasing element 14, such as the spring 74 and the piston 80 on the guide 16 can cause the corner key assembly 10 to hold the panel 108 in a desired position relative to the panel frame 102. In another aspect, with the jamb track 104 of the panel frame 102 positioned in the notch 40, the disc wall 72 of the roller wheel 60 frictionally engaged the end face 106 of the jamb track 104, and force exerted by the biasing element 14, such as the spring 74 and the piston 80 on the guide 16 can cause the corner key assembly 10 to hold the panel 108 in a desired position relative to the panel frame 102.

To move the panel 108 from a first position relative to the panel frame 102 to a second position that is different vertically than the first position, a user can urge the panel 108 in a desired direction relative to the panel frame 102. The frictional engagement between the guide 16 and the jamb track 104 can thereby be overcome to move the panel 108 to a desired positon. That is, the frictional engagement between the corner key assembly 10 and the panel frame 102 can be large enough to hold the panel 108 in the desired position, yet small enough that a user can easily move the panel 108 relative to the panel frame 102.

Figure 11:
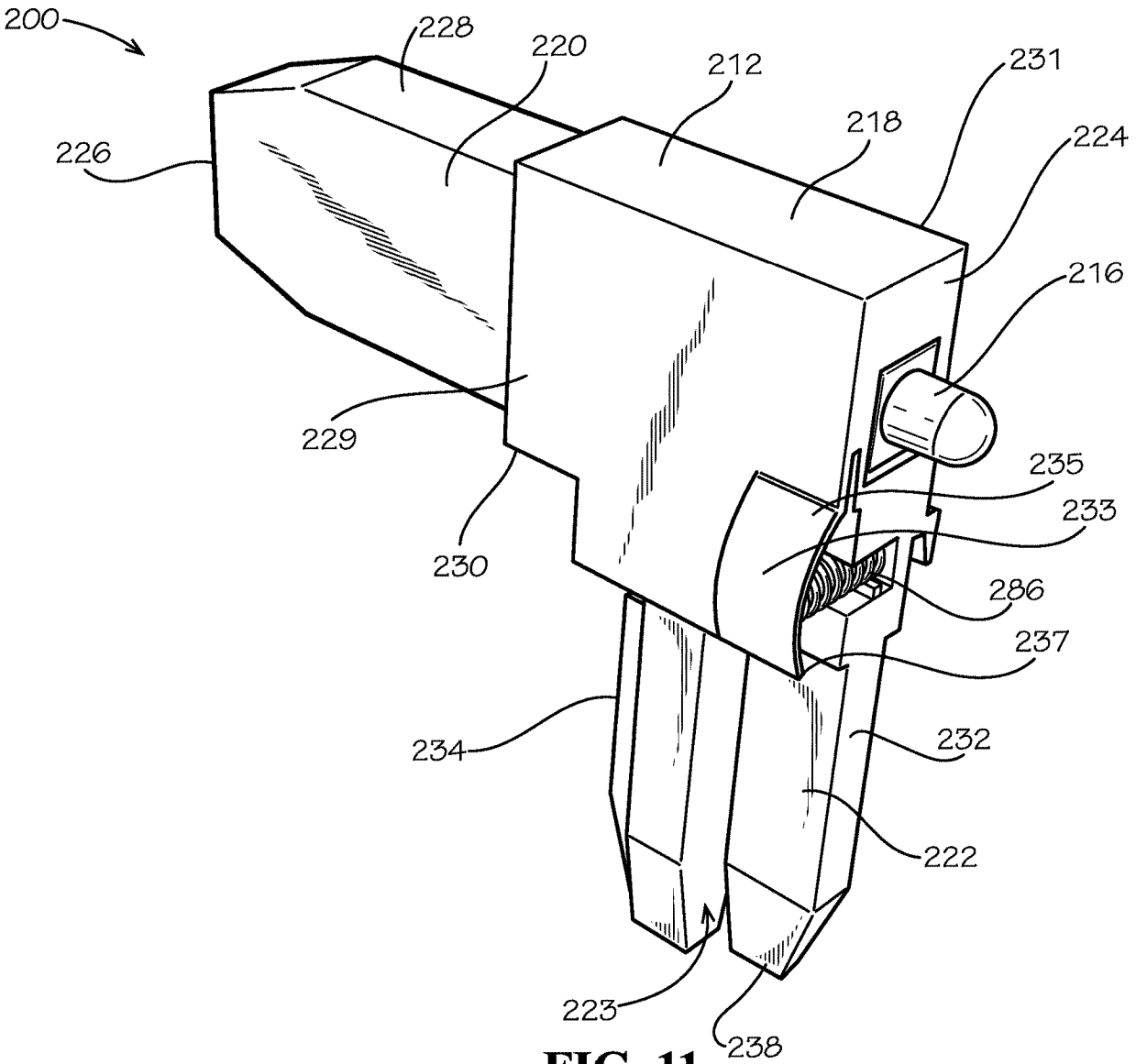
FIG. 11 is a perspective view of a corner key assembly in accordance with another aspect of the present disclosure.
Figure 13:
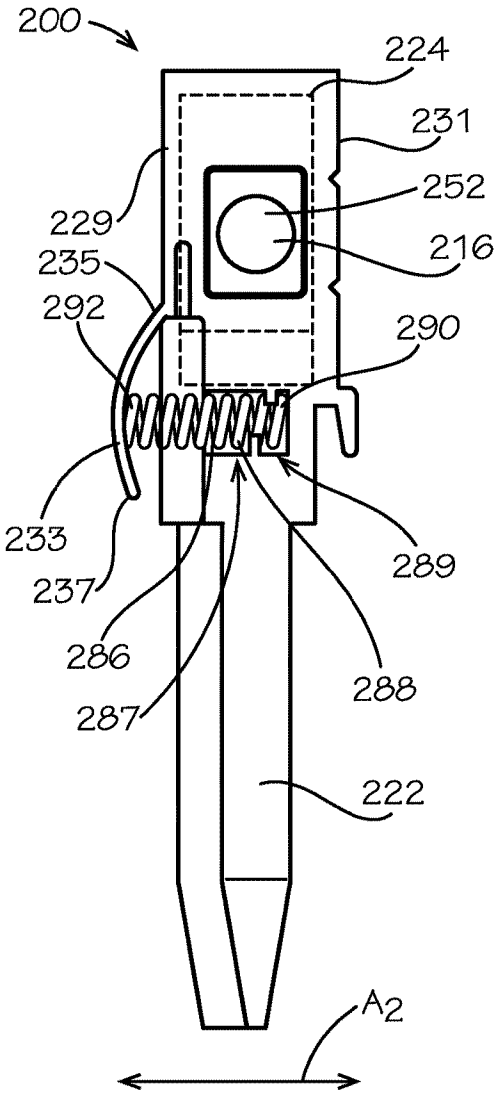
FIG. 13 is a side elevation view of the corner key assembly of FIG. 11 in which broken lines are used to illustrate interior elements of the corner key assembly.
Figure 12:
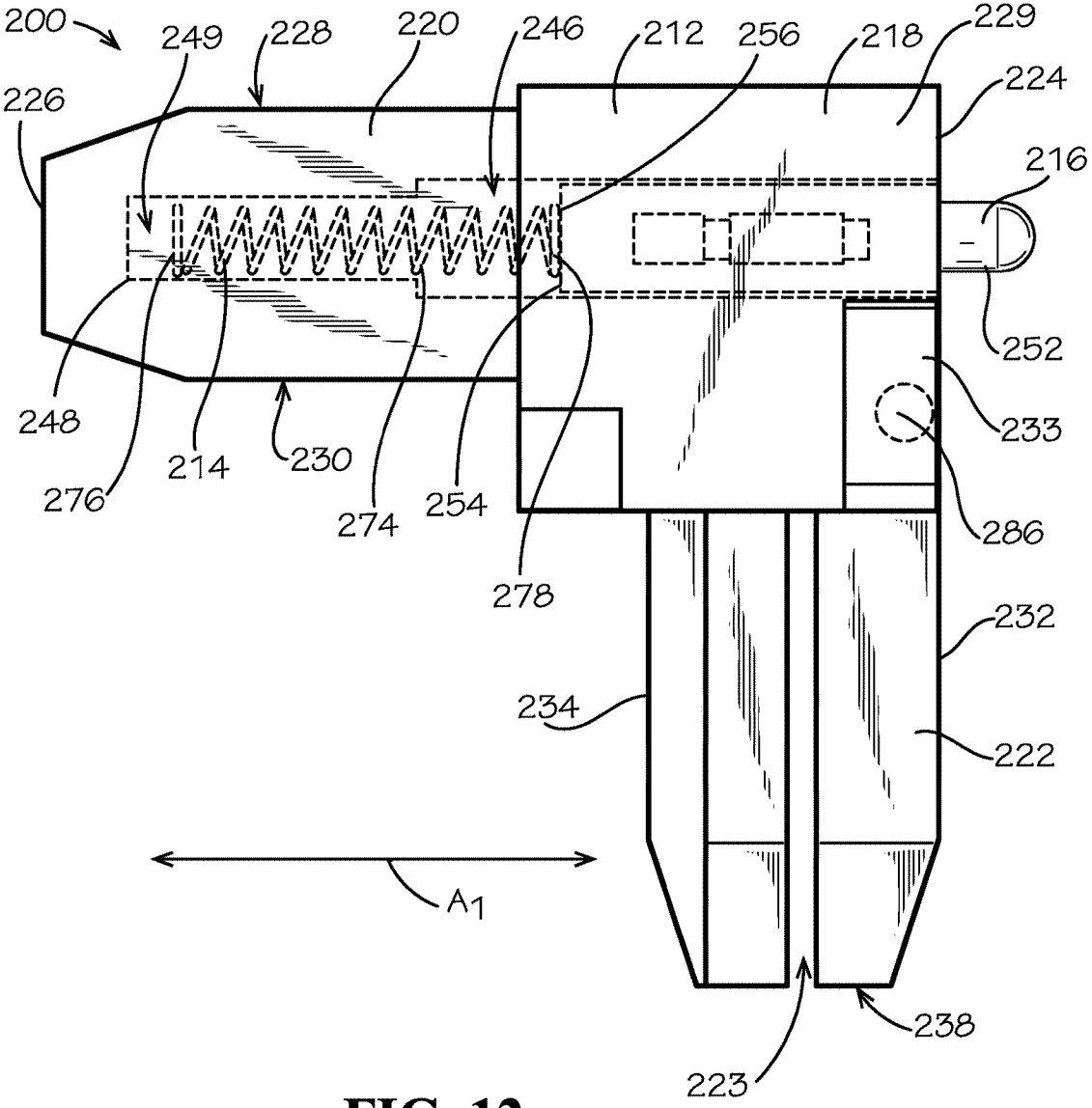
FIG. 12 is a front elevation view of the corner key assembly of FIG. 11 in which broken lines are used to illustrate interior elements of the corner key assembly.

FIGS. 11-13 illustrate another embodiment of a corner key assembly 200 comprising a corner key 212, a first biasing element 214 (shown in FIG. 12), a second biasing element 286, and a guide 216, according to various aspects. The guide 216 can be slidingly movable relative to the corner key 212 so that in use, the first biasing element 214 can urge the guide 216 into frictional engagement with a portion of a panel frame 102, such as a jamb track 104 (shown as jamb tracks 104*a,b,c* in FIG. 16), and the second biasing element 286 can urge a portion of the corner key 212 into frictional engagement with the panel frame 102.

The corner key 212 comprises a key body 218 comprising an upper body portion 220 coupled to or formed monolithically with a lower body portion 222. The upper body portion 220 comprises a distal end 224, a proximal end 226 spaced from and opposed to the distal end 224, an upper surface 228 extending between the distal end 224 and the proximal end 226, and a lower surface 230 spaced from and opposed to the upper surface 228. The upper body portion 220 further comprises a first side 229 extending between the distal end 224 and the proximal end 226, and a second side 231 spaced from and opposed to the first side 229.

The lower body portion 222 comprises a distal end 232, a proximal end 234 spaced from and opposed to the distal end 232, and a lower surface 238 spaced from and opposed to the upper surface 228. With the distal end 224 of the upper body portion 220 substantially aligned with the distal end 232 of the lower body portion 222, the upper body portion 220 can be coupled to or formed monolithically with the lower body portion 222. In one aspect, a width of the lower body portion 222 can be less than a width of the upper body portion 220 so that when the upper body portion 220 and the lower body portion 222 are coupled together or formed monolithically, the key body 218 can be substantially L-shaped. Alternatively and in other aspects, the width of the lower body portion 222 can be greater than or substantially equal to the width of the upper body portion 220. In another aspect, at least one longitudinal slot 223 can be defined in the lower body portion 222. In this aspect, the slot 223 can extend from the lower surface 238 of the lower body portion 222 towards the upper body portion 220.

As shown in FIG. 12, a guide chamber 246 can be defined in the key body 218. The guide chamber 246 can be sized and configured to receive at least a portion of the guide 216 therein. In one aspect, the guide chamber 246 can be defined in the upper body portion 220 and can extend from the distal end 224 towards the proximal end 226 of the upper body portion 220. That is, the guide chamber 246 can be an elongate chamber positioned along a first longitudinal axis $A_1$ extending from the proximal end 226 to the distal end 224 of the upper body portion 220. In another aspect, the guide chamber 246 can be sized so the guide chamber 246 has a chamber length greater than a length of the guide 216.

In other aspects, the key body 218 can further comprise a first biasing element mount 248 defined in or positioned on the proximal end 226 of the upper body portion 220 of the key body 218 and facing the guide chamber 246. The first biasing element mount 248 can be configured to secure the first biasing element 214 in a desired position relative to the key body 218. In one aspect, the first biasing element mount 248 can comprise a first recessed area 249 defined in the proximal end 226 of the upper body portion 220 facing the guide chamber 246. In this aspect, the first recessed area 249 can be in communication with the guide chamber 246 so that the first biasing element 214 positioned in the first recessed area 249 can extend into a portion of the guide chamber 246. In another aspect, the guide chamber 246 and/or the first recessed area 249 can be elongate voids extending substantially parallel to the first longitudinal axis $A_1$ and extending from the proximal end 226 to the distal end 224 of the upper body portion 220. In use, described more fully below, the first recessed area 249 can secure the first biasing element 214 in a desired position in key body 218.

As shown in FIG. 13, a portion of the first side 229 of the key body 218 can be substantially planar and, in one aspect, an arm 233 can extend away from the first side 229 a predetermined distance. In some aspects, the arm 233 can comprise an attachment end 235 flexibly formed with or hingedly attached to the first side 229, and a free end 237 spaced from the attachment end 235. In use, the arm 233 can be movable relative to the key body 218 so that the free end 237 of the arm 233 can be urged about and between a first arm position, in which the free end 237 is a first distance away from the first side 229, and a second arm position, in which the free end 237 is a second distance away from the first side 229 that is greater than the first distance. In use, described more fully below, in the second arm position, the free end 237 engages a portion of the panel frame 102.

Optionally, in some aspects, the key body 218 can further comprise a second biasing element mount 287 defined in the upper body portion 220 and extending from the first side 229 towards the second side 231. The second biasing element mount 287 can be configured to secure the second biasing element 286 in a desired position relative to the key body 218. In some aspects, the second biasing element mount 287 can comprise a second recessed area 289 defined in the upper body portion 220. In this aspect, the second recessed area 289 can be sized so that the second biasing element 286 positioned in the second recessed area 289 can extend away from the first side 229 of the key body 218 and towards the arm 233. In some aspects, the second recessed area 289 can be an elongate void along a second longitudinal axis $A_2$ that is substantially normal to the first longitudinal axis $A_1$. In use, described more fully below, the second recessed area 289 can secure the second biasing element 286 in a desired position in key body 218.

As shown in FIG. 12, the guide 216 can be an insert slidingly positionable in the guide chamber 246 of the key body 218. That is, the guide 216 can be sized and configured to be positioned in the guide chamber 246. The guide 216 comprises a first end 252 and an opposed second end 254 spaced from the first end 252. In one aspect, the second end 254 of the guide 216 can be sized and configured to couple to or engage the first biasing element 214. For example, a guide mount 256 can be defined in or positioned on the second end 254 of the guide 216. The guide mount 256 of the guide 216 can be at one or more tabs (not shown) extending away from the second end 254 or one or more holes (not shown) defined in the second end 254 of the guide 216 to secure the first biasing element 214 in a desired position relative to the guide 216. In some aspects, the thickness of the first end 252 of the guide 216 can be less than, greater than or substantially equal to the thickness of the second end 254 of the guide 216.

Figure 16:
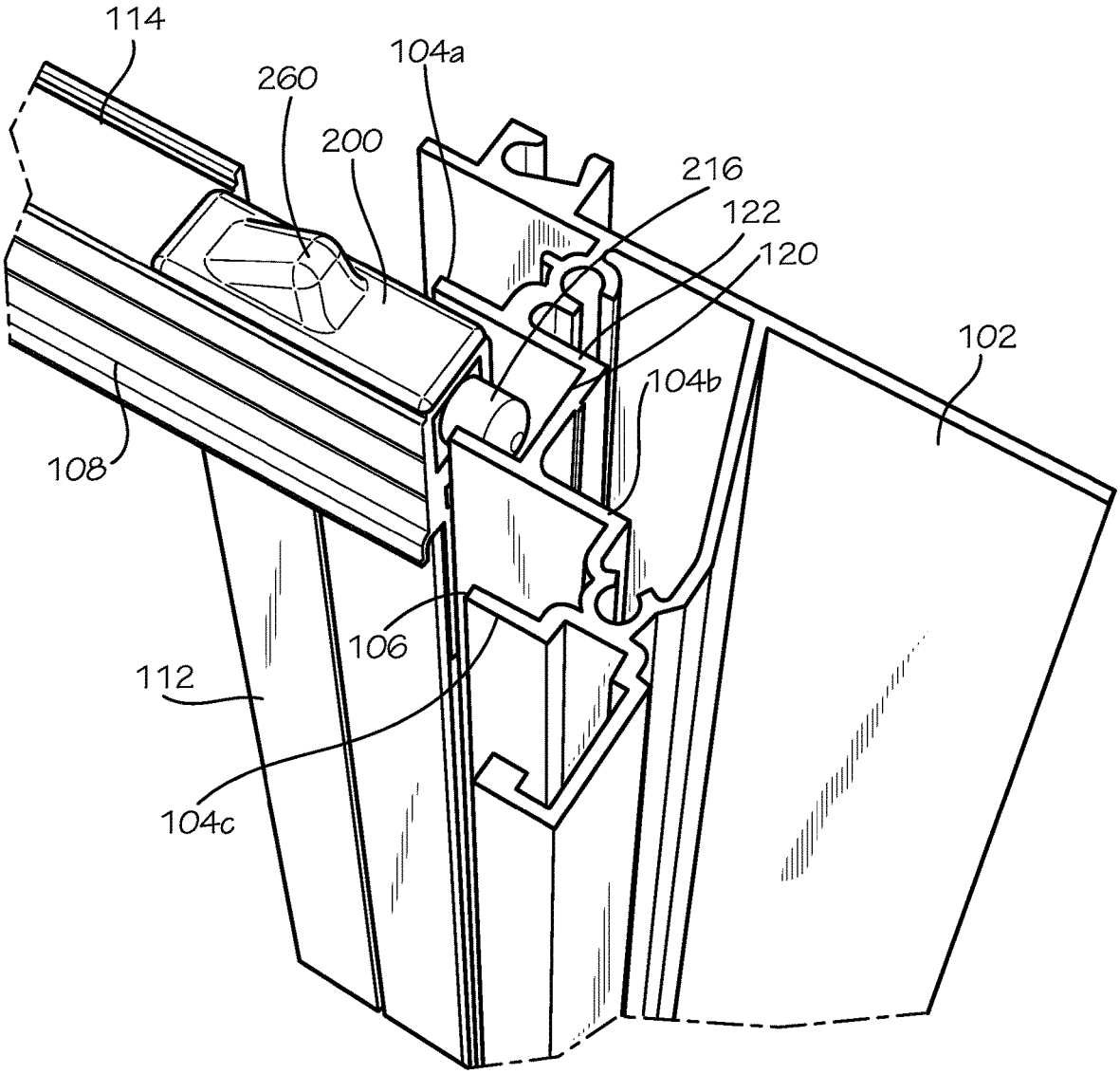
FIG. 16 is a perspective view of a panel assembly comprising a panel frame and a panel comprising the corner key assembly of FIGS. 11 and 14.

In one aspect, the first end 252 of the guide 216 can be sized and configured to frictionally engage the jamb track 104 of the panel frame 102 (illustrated in FIG. 16). For example, the first end 252 of the guide 216 can be a substantially spherical surface configured to engage an end face 106 of the jamb track 104. Optionally, the first end 252 of the guide 216 can be configured to slide between adjacent jamb tracks 104*a,b,c* so that contact between the first end 252 and the jamb track 104 can maintain the corner key 200 in a desired position relative to the frame 102.

The first biasing element 214 can be positioned between the proximal end 226 of the upper body portion 220 of the key body 218 and the second end 254 of the guide 216 and configured to urge the guide 216 away from the proximal end 226. That is, the first biasing element 214 can be configured to urge the guide 216 along the first longitudinal axis $A_1$ extending from the proximal end 226 to the distal end 224 of the upper body portion 220. In one aspect and as illustrated in FIGS. 12-13, the first biasing element 214 can be a first spring 274 comprising a first spring end 276 coupled to or positioned in the first recessed area 249 of the key body 218, and an opposed second spring end 278 coupled to or in contact with the guide 216. It is contemplated that any number of first springs 274 can be present as desired in various other aspects. The first spring 274 can be a compressive spring configured to urge the guide 216 away from the proximal end 226 until the first end 252 of the guide 216 extends from the guide chamber 246 and beyond the distal end 224 of the key body 218 a predetermined distance.

The second biasing element 286 can be positioned between the second side 231 of the key body 218 and the arm 233 and configured to urge the arm 233 away from the first side 229 of the key body 218. That is, the second biasing element 286 can be configured to urge the arm 233 away from the first side 229 along the second longitudinal axis $A_2$ that is substantially normal to the first longitudinal axis $A_1$. In one aspect and as illustrated in FIG. 13, the second biasing element 286 can be a second spring 288 comprising a first spring end 290 coupled to or positioned in the second recessed area 289 of the key body 218, and an opposed second spring end 292 coupled to or in contact with the arm 233. It is contemplated that any number of second springs 288 can be present as desired in various other aspects. The second spring 288 can be a compressive spring configured to urge the arm 233 away from the first side 229 until the arm 233 extends away from the first side 229 a predetermined distance.

To assemble the corner key assembly 200 as illustrated in FIGS. 11-13, the guide 216 can be positioned in the guide chamber 246 with the second end 254 of the guide 216 facing the proximal end 226 of the upper body portion 220. The first spring 274 can be positioned in the guide chamber 246 with the first spring end 276 of the first spring 274 coupled to or positioned in the first recessed area 249 of the key body 218. The second spring end 278 of the first spring 274 can be coupled to or positioned in the guide mount 256 of the guide 216. In the assembled position, the first spring 274 can urge the first end 252 of the guide 216 along the first longitudinal axis $A_1$ away from the distal end 224 of the key body 218 a predetermined distance. In one aspect, the first spring 274 can be compressed such that the guide 216 can be positioned completely in the guide chamber 246.

The second spring 288 can be positioned in the second biasing element mount 287 with the first spring end 290 of the second spring 288 positioned adjacent to the second side 231. The second spring end 292 of the second spring 288 can be coupled to or positioned adjacent to the arm 233. In the assembled position, the second spring 288 can move along the second longitudinal axis $A_2$ to urge the arm 233 away from the first side 229 of the key body 218 a predetermined distance. Thus, the first spring 274 can urge the guide 216 away from the key body 218 in a first direction, and the second spring 288 can urge the arm 233 away from the key body 218 in a second direction that is substantially normal to the first direction.

Figure 14:
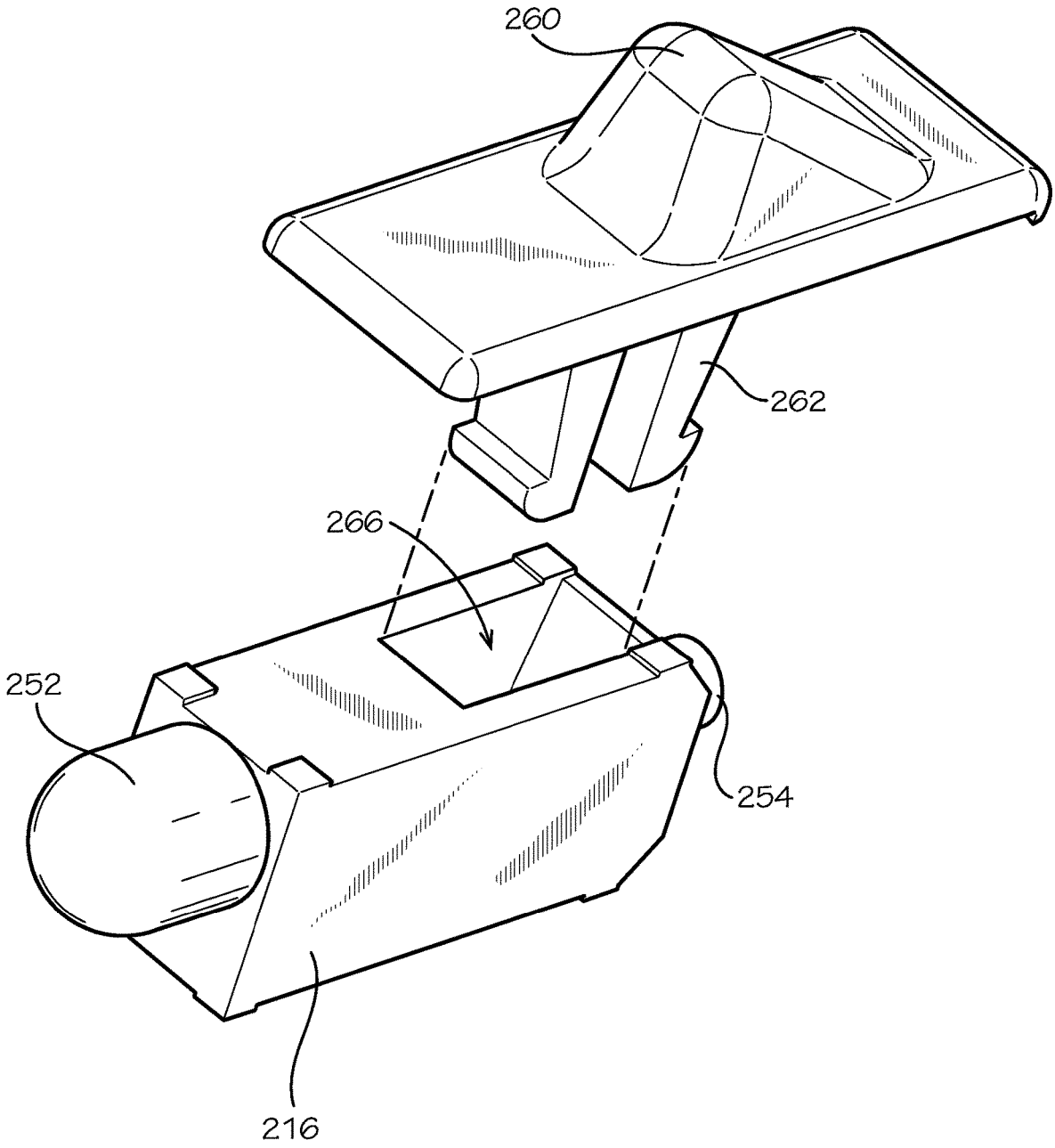
FIG. 14 is an exploded perspective view of a button and guide of a corner key assembly, in accordance with another aspect of the present disclosure.
Figure 15:
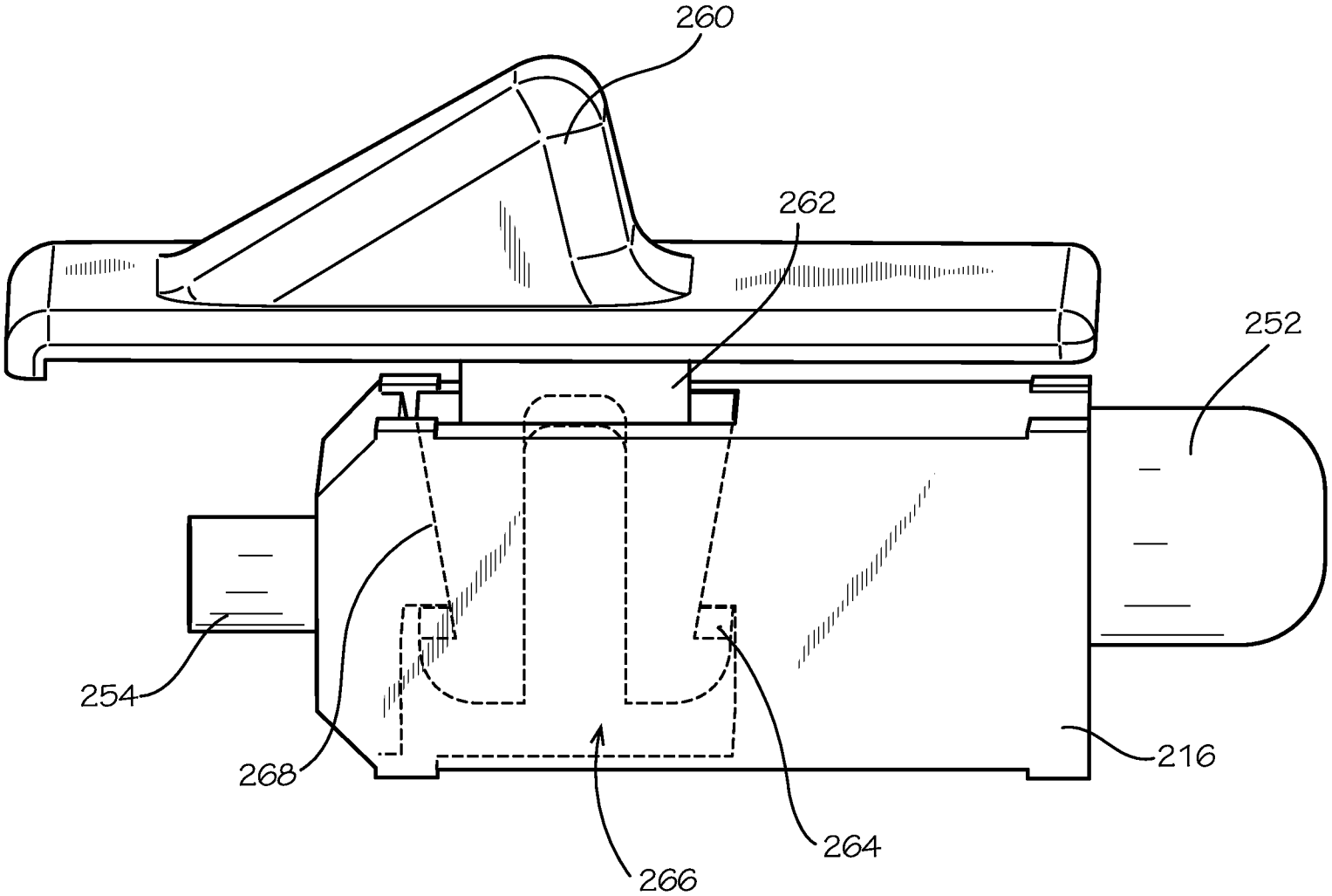
FIG. 15 is a perspective view of the button and guide of FIG. 14 in which broken lines are used to illustrate interior elements of the corner key assembly.

In some aspects and with reference to FIGS. 14-16, the corner key assembly 200 can further comprise a button 260 positioned on the upper surface 228 of the key body 218. In this aspect, the button 260 can be configured to allow a user to urge the guide 216 towards the proximal end 226 of the key body 218 until the first end 252 of the guide 216 is positioned in the guide chamber 246 or extends from the guide chamber 246 a predetermined distance. That is, the button 260 can allow the user to urge the guide 216 away from the jamb track 104 so that the panel assembly 100 can be removed from the panel frame 102.

The button 260 can comprise a pair of prongs 262 extending away from the button 260. As shown in FIG. 15, a locking tab 264 can be formed on an end of each prong 262. In one aspect, the prongs 262 and the locking tabs 264 can be configured to be positioned in a button chamber 266 defined in a portion of the guide 216. Engagement between the prongs 262 and the locking tabs 264 of the button 260 with at least one interior surface 268 of the button chamber 266 can securedly attach the button 260 to the guide 216. When positioned in the corner key assembly 200, the button 260 can be spaced from the guide 216 a predetermined distance so that the upper surface 228 of the key body 218 can be positioned between the button 260 and the guide 216. In some aspects, the first biasing element 214 can urge the first end 252 of the guide 216 outwardly away from the key body 218, and the button 260 can be engaged by a user to urge the first end 252 inwardly into the guide chamber 246 of the key body 218.

The corner key assembly 200 can be positioned in a panel 108 of a panel assembly 100, illustrated in FIG. 16. The panel assembly 100 can be any type of panel assembly, including, for example and without limitation, a window, a screen, a vent, or a clear plastic viewing panel. The panel assembly 100 can comprise the panel 108 that is slidable vertically relative to the fixed panel frame 102. For example, the panel 108 can slide vertically relative to a respective jamb track 104*a,b,c,d*. It is contemplated, that the panel assembly 100 can comprise any number of panels 108. Each panel 108 can comprise a first stile 110, a second stile 112 spaced from and opposed to the first stile 110, a first rail 114 coupled to and extending between the first stile 110 and the second stile 112, and a second rail 116 coupled to and extending between the first stile 110 and the second stile 112, the second rail 116 being spaced from and opposed to the first rail 114.

In one aspect, the corner key assembly 200 can be positioned in a corner of the panel 108 where the first stile 110 or the second stile 112 is coupled to the first rail 114 and/or the second rail 116. For example, the upper body portion 20 of the key body 18 can be positioned in the first rail 114 or the second rail 116, and the lower body portion 22 of the key body 18 can be positioned in the first stile 110 or the second stile 112. In some aspects, the corner key assembly 200 can be positioned in a top corner of the panel 108, and a second corner key assembly 200 can be positioned in an opposite top corner of the panel 108. In some aspects, the corner key assembly 10 can be positioned in the panel 108 such that portions of the key body 18, such as the distal end 24 of the key body 18 or the guide rail 44, are substantially aligned with a distal edge 118 of the first stile 110 and/or the second stile 112. In other aspects, the corner key assembly 200 can be positioned in the panel 108 such that the distal edge 118 of the first stile 110 and/or the second stile 112 extends beyond the distal end 224 of the key body 218. In another aspects, the distal end 224 of the key body 218 can be substantially parallel with the distal edge 118 of the first stile 110 and/or the second stile 112.

Each panel 108 of the panel assembly 100 can be positioned on the panel frame 102 such that the guide 216 is positioned between two jamb tracks 104*a,b,c* of the panel frame 102. In one aspect, the first end 252 of the guide 216 can frictionally engage an inner surface 120 of the panel frame 102, and a portion of the arm 233 can frictionally engage a side surface 122 of the jamb track 104. Optionally the first end 252 of the guide 216 can slide between two adjacent jamb tracks 104*a,b,c* to keep the panel oriented properly with respect to the panel frame 102. Force exerted by the first biasing element 214 on the guide 216 and force exerted by the second biasing element 286 on the arm 233 can cause the corner key assembly 200 to hold the panel 108 in a desired position relative to the panel frame 102.

To move the panel 108 from a first position relative to the panel frame 102 to a second position that is different vertically than the first position, a user can urge the panel 108 in a desired direction relative to the panel frame 102. The frictional engagement between the guide 216 and the jamb track 104, and/or between the arm 233 and the jamb track 104 can thereby be overcome to move the panel 108 to a desired positon. That is, the frictional engagement between the corner key assembly 200 and the panel frame 102 can be large enough to hold the panel 108 in the desired position, yet small enough that a user can easily move the panel 108 relative to the panel frame 102.

In some aspects, to remove the panel 108 from the panel frame 102, the user can urge the button 260 so that the first end 252 of the guide 216 is moved inwardly toward the guide chamber 246 of the key body 218 until the first end 252 is clear of the jamb track 104. With the first end 252 of each corner key 200 clear of the jamb track 104, the panel 108 can be removed from the jamb track 104.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A corner key assembly for a sliding panel system comprising a panel frame and a panel slidingly movable relative to the panel frame, the corner key assembly comprising:

a corner key comprising a distal end and a proximal end spaced from and opposed to the distal end, and a guide chamber being defined in the corner key, the guide chamber extending from the distal end towards the proximal end of the corner key along a first longitudinal axis, the corner key further comprising a biasing element mount defined in the proximal end of the corner key and projecting into the guide chamber;

a guide slidingly movable relative to the corner key, at least a portion of the guide being configured to be positioned in the guide chamber and a portion of the guide being configured to extend from the guide chamber; and a first biasing element positioned in the guide chamber between the guide and the proximal end of the corner key, the first biasing element configured to urge a portion of the guide from the guide chamber away from the corner key and into frictional engagement with the panel frame to hold the panel in a desired position relative to the panel frame, wherein the biasing element mount extends towards and engages the first biasing element to secure the first biasing element in a desired position relative to the corner key;

wherein the corner key further comprises a first side extending between an upper surface and a lower surface, wherein an arm extends away from the first side a predetermined distance, wherein a free end of the arm is movable relative to the corner key about and between a first arm position, in which the free end is a first distance away from the first side, and a second arm position, in which the free end is a second distance away from the first side that is greater than the first distance, and wherein in the second arm position, the free end engages a portion of the panel frame.

2. The corner key assembly of claim 1, wherein the corner key comprises a key body comprising an upper body portion formed monolithically with a lower body portion, and wherein a width of the lower body portion is less than a width of the upper body portion.

3. The corner key assembly of claim 2, wherein a longitudinal notch is defined in the distal end of the corner key such that the guide chamber is in communication with the notch, and wherein the longitudinal notch is defined in the distal end of the upper body portion and in the distal end of the lower body portion of the key body.

4. The corner key assembly of claim 2, wherein the guide chamber is defined in the distal end of the upper body portion of the key body.

5. The corner key assembly of claim 1, wherein the guide comprises a first end and an opposed second end spaced from the first end, wherein the second end of the guide is configured to engage the first biasing element, and wherein the first end of the guide is configured to frictionally engage the panel frame.

6. The corner key assembly of claim 5, wherein the guide further comprise a first face extending between the first end and the second end, and a second face extending between the first end and the second end and opposed to the first face, and wherein a bore is defined in the guide, the bore extending from the first face to the second face of the guide.

7. The corner key assembly of claim 6, wherein the bore is a substantially cylindrical bore comprising an inner diameter, and wherein the inner diameter of the bore extends beyond the first end of the guide.

8. The corner key assembly of claim 1, wherein the guide comprises a roller wheel positioned in a bore of the guide such that the roller wheel rotatingly engages the panel frame.

9. The corner key assembly of claim 8, wherein the roller wheel has a first disc face, a second disc face, and a disc wall extending between the first disc face and the second disc face, and wherein the a portion of the first disc face, the second disc face, and the disc wall of the roller wheel extend beyond the first end of the guide.

10. The corner key assembly of claim 1, wherein the first biasing element comprises a spring comprising a first spring end in contact with the corner key, and an opposed second spring end in contact with the guide, and wherein the spring is configured to bias the second spring end of the spring away from the first spring end, and wherein the biasing element mount extends through a center of the spring.

11. The corner key assembly of claim 1, further comprising a second biasing element configured to urge the arm away from the first side of the corner key along a second longitudinal axis that is substantially normal to the first longitudinal axis.

12. A panel assembly comprising:

a panel frame comprising a plurality of jamb tracks; and a panel slidable vertically relative to the panel frame along a jamb track of the plurality of jamb tracks, the panel comprising a first stile, a second stile spaced from and opposed to the first stile, a first rail coupled to and extending between the first stile and the second stile, a second rail coupled to and extending between the first stile and the second stile, the second rail being spaced from and opposed to the first rail, and a corner key assembly comprising:

a corner key comprising a distal end and a proximal end spaced from and opposed to the distal end, and a guide chamber being defined in the corner key, the guide chamber extending from the distal end towards the proximal end of the corner key along a first longitudinal axis;

a guide slidingly movable relative to the corner key, at least a portion of the guide being configured to be positioned in the guide chamber and a first end of the guide being configured to extend from the guide chamber; and a biasing element positioned in the guide chamber between the guide and the proximal end of the corner key, the biasing element configured to urge the first end of the guide away from the corner key and into frictional engagement with an end face the jamb track to hold the panel in a desired position relative to the panel frame, wherein the first end of the guide is configured to slide vertically along the end face of the jamb track upon application of a suitable force to the panel;

wherein the corner key further comprises a first side extending between the upper surface and the lower surface, wherein an arm extends away from the first side a predetermined distance, wherein a free end of the arm is movable relative to the corner key about and between a first arm position, in which the free end is a first distance away from the first side, and a second arm position, in which the free end is a second distance away from the first side that is greater than the first distance, and wherein in the second arm position, the free end engages a portion of the panel frame.

13. The panel assembly of claim 12, wherein the corner key assembly is positioned in a corner of the panel where the first stile is coupled to the first rail.

14. The panel assembly of claim 12, wherein the guide comprises a roller wheel comprising a first disc face, a second disc face, and a disc wall extending between the first disc face and the second disc face, and wherein the roller wheel is positioned in a bore of the guide such that a portion of the first disc face, the second disc face, and the disc wall of the roller wheel extend beyond the first end of the guide.

15. The panel assembly of claim 14, wherein the disc wall of the roller wheel rotatingly engages the end face of the jamb track of the panel frame.

16. The panel assembly of claim 12, wherein the biasing element comprises a piston comprising a first piston end in contact with the corner key and an opposed second piston end in contact with the guide, and wherein the piston is configured to urge the second piston end of the piston away from the first piston end.

17. The panel assembly of claim 12, further comprising a second biasing element configured to urge the arm away from the first side of the corner key along a second longitudinal axis that is substantially normal to the first longitudinal axis.

* * * * *